US008167403B2

(12) United States Patent
Sugahara

(10) Patent No.: US 8,167,403 B2
(45) Date of Patent: May 1, 2012

(54) DROPLET EJECTOR

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 265 days.

(21) Appl. No.: 12/626,427

(22) Filed: Nov. 25, 2009

(65) Prior Publication Data

US 2010/0128089 A1 May 27, 2010

(30) Foreign Application Priority Data

Nov. 25, 2008 (JP) ..... 2008-298953

(51) Int. Cl.
*B41J 2/145* (2006.01)
*B41J 2/15* (2006.01)

(52) U.S. Cl. ..... 347/40; 347/65; 347/49

(58) Field of Classification Search ..... 347/40, 347/42, 47, 49, 65–67, 85, 86
See application file for complete search history.

(56) References Cited

U.S. PATENT DOCUMENTS

| | | | | |
|---|---|---|---|---|
| 5,835,110 | A * | 11/1998 | Sasaki | 347/40 |
| 6,467,870 | B2 | 10/2002 | Matsumoto et al. | |
| 6,857,722 | B1 * | 2/2005 | Greiser et al. | 347/40 |
| 7,077,501 | B2 * | 7/2006 | Kitahara et al. | 347/40 |
| 7,407,267 | B2 | 8/2008 | Enomoto et al. | |
| 7,431,428 | B2 | 10/2008 | Yamada | |
| 2004/0160475 | A1 | 8/2004 | Satoh et al. | |
| 2004/0179062 | A1 | 9/2004 | Rai et al. | |
| 2006/0290740 | A1 | 12/2006 | Akahane | |
| 2008/0030563 | A1 | 2/2008 | Yoshida | |
| 2009/0244240 | A1 | 10/2009 | Sugahara | |
| 2010/0128077 | A1 | 5/2010 | Sugahara | |

FOREIGN PATENT DOCUMENTS

| | | | |
|---|---|---|---|
| JP | 2002-096462 | A | 4/2002 |
| JP | 2002-240300 | A | 8/2002 |
| JP | 2004-276374 | A | 10/2004 |
| JP | 2005-119029 | A | 5/2005 |
| JP | 2005-329595 | A | 12/2005 |
| JP | 2006-205689 | A | 8/2006 |
| JP | 2007-001108 | A | 1/2007 |
| JP | 2007-021909 | A | 2/2007 |
| JP | 2008-036906 | A | 2/2008 |

OTHER PUBLICATIONS

Japan Patent Office, Notice of Reasons for Rejection for Japanese Patent Application No. 2008-298954 (counterpart to co-pending U.S. Appl. No. 12/626,125), mailed Oct. 12, 2010.
United States Patent and Trademark Office, Office Action for U.S. Appl. No. 12/626,125 (related to above-captioned patent application), issued Dec. 30, 2011.

* cited by examiner

*Primary Examiner* — Thinh Nguyen
(74) *Attorney, Agent, or Firm* — Baker Botts L.L.P.

(57) ABSTRACT

The droplet ejector includes: a head unit set composed of four head units arranged in a staggered manner in the arrangement direction; a head supporting member which supports the head unit set; a liquid supplier which supplies liquid to the head unit set; and a conveyor mechanism which conveys an ejection target. Each head unit has a passage structure having a liquid passage. At one edge of the passage structure in the arrangement direction, a liquid supply opening which is connected to the liquid passage and the liquid supplier is provided. Two passage structures neighboring in the arrangement direction are disposed so that the respective edges where the liquid supply openings are provided oppose each other in the arrangement direction.

6 Claims, 11 Drawing Sheets

DROPLET EJECTOR

CROSS REFERENCE TO RELATED APPLICATION

The present application claims priority from Japanese Patent Application No. 2008-298953, which was filed on Nov. 25, 2008, the disclosure of which is herein incorporated by reference in its entirety.

BACKGROUND OF THE INVENTION

1. Field of the Invention

The present invention relates to a droplet ejector which ejects a droplet from a nozzle formed in a head unit.

2. Description of Related Art

In the field of inkjet heads, a head may be constructed as follows for improving the yield: plural head units each having plural nozzles aligned in a single direction are combined with each other so that the intervals among nozzles are equal in one direction and a single nozzle row longer than the nozzle row of each head unit is formed. This approach, however, is disadvantageous in that a nozzle row is discontinued at the border between two adjacent head units (i.e. the interval between the nozzles is wide) if the head units are simply provided to stretch in the arrangement direction of the nozzles. To address this problem, it is conceivable for example to form an inkjet head having a virtual single nozzle row longer than the nozzle row of each head unit by providing the head units in a staggered manner along the arrangement direction of the nozzles.

In the meanwhile, each of the head units constituting the aforesaid head has a supply opening by which liquid is commonly supplied to plural nozzles, and this supply opening is connected by a liquid supplier such as a tube to a tank which stores liquid. Each head unit ejects from the nozzles the liquid which has been supplied from the tank to the supply opening via the liquid supplier.

SUMMARY OF THE INVENTION

Provided that supply openings connected to the liquid supplier are formed at the same position of each head unit, The positions where the supply openings are formed are far from each other between adjacent head units, with the result that the entire apparatus requires a large size if a single liquid supplier is adopted or each head unit requires a corresponding liquid supplier.

In light of the problem above, an object of the present invention is to provide a droplet ejector which can supply liquid to four head units of a head unit set by a single liquid supplier which is small in size.

A droplet ejector of the present invention includes: at least one head unit set each composed of four head units which are disposed in a staggered manner in an arrangement direction on a plane; a head supporting member which supports said at least one head unit set; a liquid supplier which supplies liquid to said at least one head unit set; and a conveyor mechanism which conveys, in an area opposing said at least one head unit set, an ejection target in a direction in parallel to the plane; each of the head units including: a passage structure having plural nozzles disposed in the arrangement direction and a liquid passage connected to the nozzles; and a liquid supply opening which is provided at an edge of passage structure in the arrangement direction and which is connected to the liquid passage and the liquid supplier, the passage structures of two of the head units neighboring each other in the arrangement direction being arranged so that the respective edges where the liquid supply openings are provided oppose each other in the arrangement direction.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

<First Embodiment>

Now, an inkjet printer of a preferred First Embodiment of the present invention will be discussed. The inkjet printer of the present embodiment adopts an inkjet head which is arranged such that plural head units are provided in a staggered manner along the main scanning direction so that plural long nozzle rows are formed along the main scanning direction.

Figure 1:
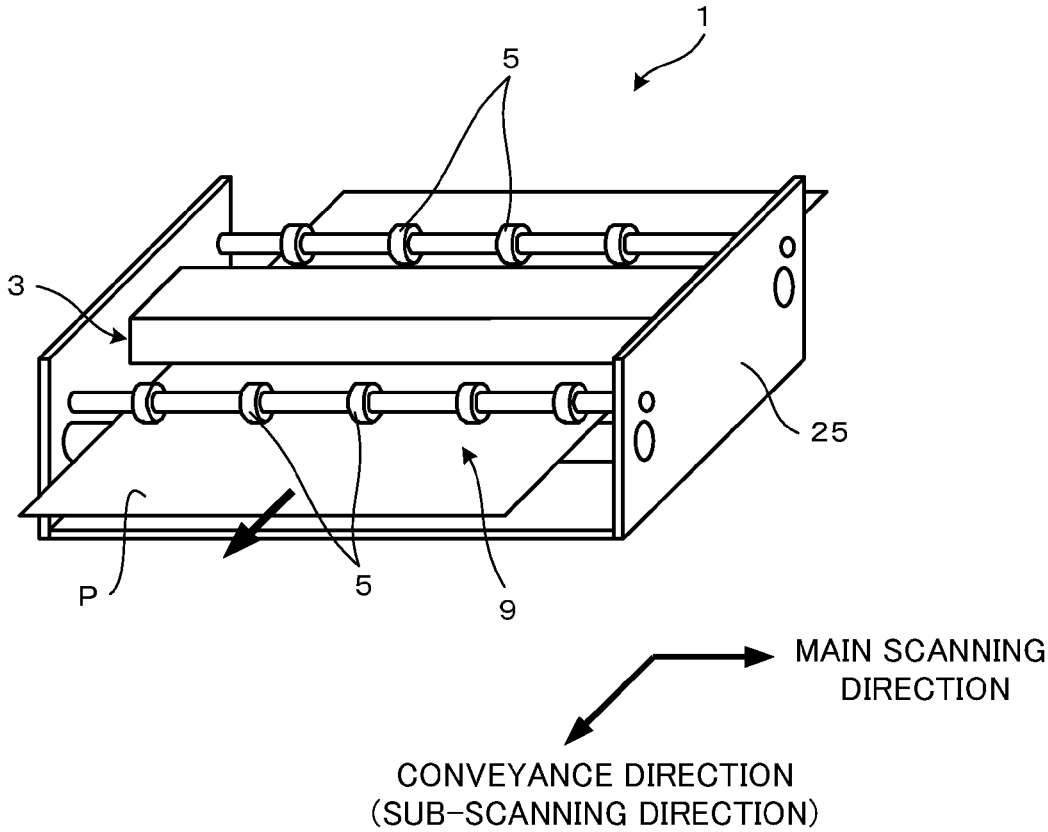
FIG. 1 is a schematic diagram of an inkjet printer of an embodiment of the present invention.

As illustrated in FIG. 1, the inkjet printer 1 (droplet ejector) includes: a line-type inkjet head 3 which extends in the horizontal direction of FIG. 1 (i.e. main scanning direction) and ejects ink onto a record sheet P (ejection target); and a conveyor mechanism 9 which transports a record sheet P towards the viewer of FIG. 1 (i.e. in the conveyance direction (sub-scanning direction) orthogonal to the main scanning direction). This inkjet printer 1 conveys a record sheet P toward the viewer of FIG. 1 by the conveyor mechanism 9 at the same time causes the inkjet head 3 to eject ink onto the record sheet P, so as to print a desired image, text, or the like on the record sheet P.

The conveyor mechanism 9 has two conveyor rollers 5 provided on the both sides of the inkjet head 3 in the conveyance direction. At the position opposing a later-mentioned ink ejection surface 7 of the head unit 2, the conveyor mechanism 9 conveys, by the conveyor rollers 5, a record sheet P in the conveyance direction and in parallel to the ink ejection surface 7.

Figure 2:
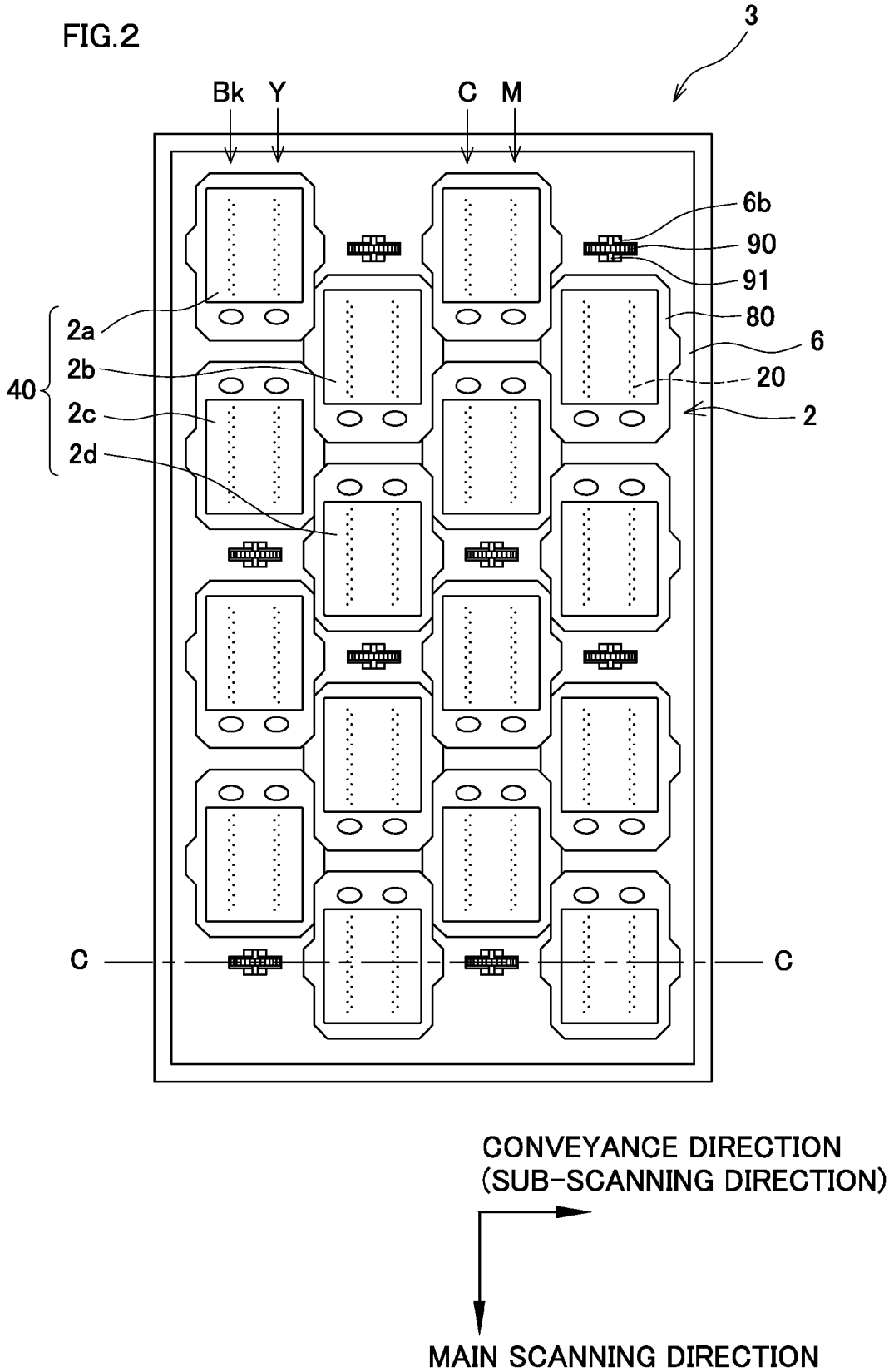
FIG. 2 is a plan view from above looking down the inkjet head.

Now, the inkjet head 3 will be discussed with reference to FIG. 2 and FIG. 3. In FIG. 2, the pressure chamber 14 and through holes 15, 16, and 19 are not illustrated for the sake of simplicity.

Figure 3:
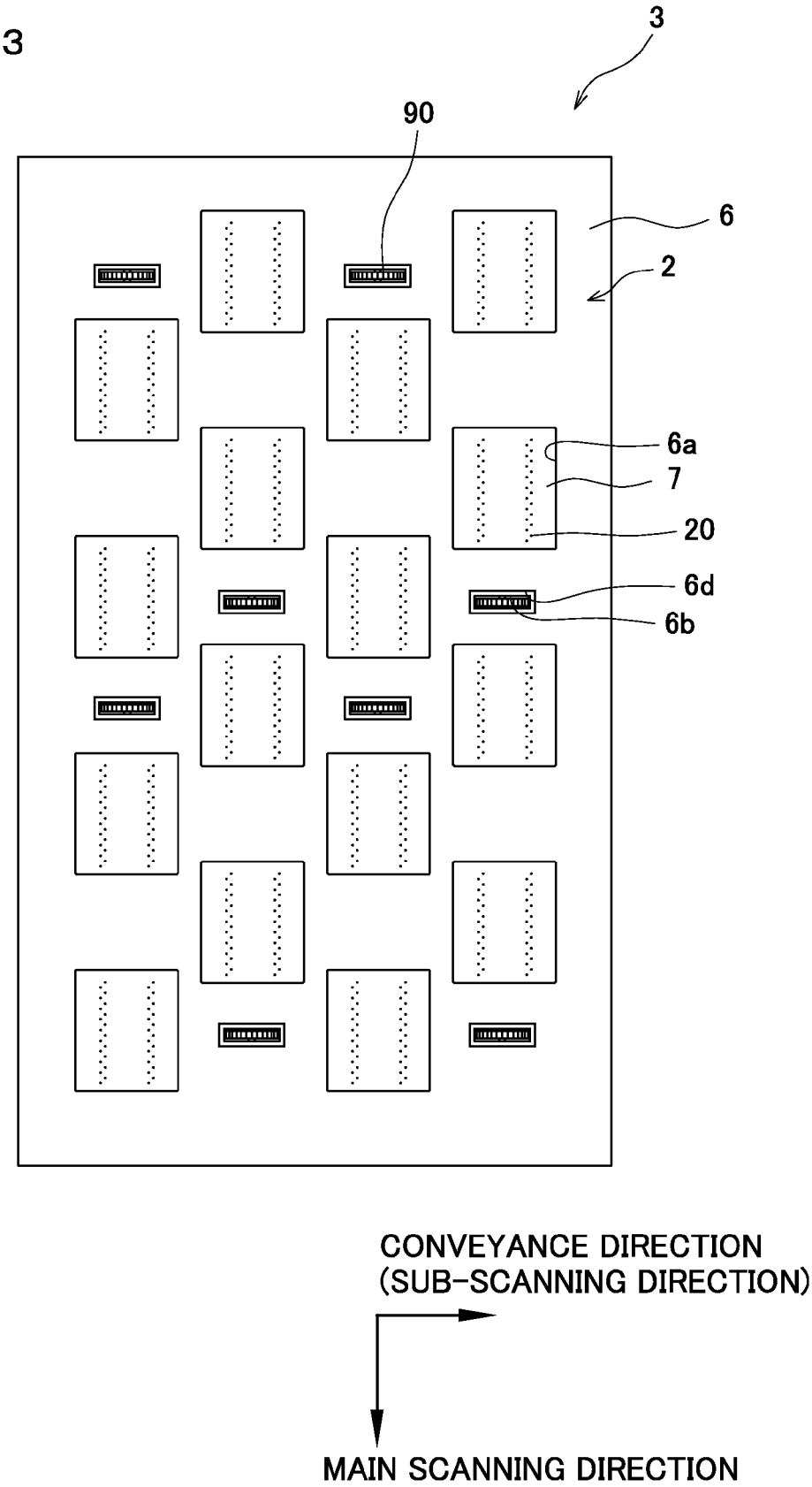
FIG. 3 is a plan view from below of the inkjet head.

As shown in FIG. 2 and FIG. 3, the inkjet head 3 includes: plural head unit 2 which form four rows in a staggered manner along the main scanning direction; plural spurs (pushing mechanisms) 90 which push a record sheet P, and a housing 6 (head supporting member) supporting the plural head units 2 and plural spurs 90.

First, the head units 2 will be discussed with reference to FIG. 4 to FIG. 7. As shown in FIG. 4 to FIG. 7, each of the head units 2 includes: a passage unit 4 (passage structure) in which an ink flow passage 22 including nozzles 20 and pressure chambers 14 is formed; a piezoelectric actuator 8 which applies pressure (ejection energy) to the ink in the pressure chambers 14 so as to eject the ink from the nozzles 20 of the passage unit 4; a flexible printed circuit 54 (FPC: wiring component) which covers the upper surface of the piezoelectric actuator 8 and is electrically connected to a later-described individual electrode 32 of the piezoelectric actuator 8; and a reinforcing plate 80 which reinforces the passage unit 4.

The passage unit 4 includes a cavity plate 10, a base plate 11, and a manifold plate 12 which are made of a metal material such as stainless steel, and a nozzle plate 13 which is made of a polymeric synthetic resin material such as polyimide. These four plates 10 to 13 are stacked and joined with one another. The nozzle plate 13 may be alternatively made of a metal material in the same manner as the plates 10 to 12.

The nozzle plate 13 has plural penetrating nozzles 20. These plural nozzles 20 are aligned in the main scanning direction (in the direction from the top to the bottom in FIG. 4) so as to form nozzle rows 21, and four nozzle rows 21 are aligned in the sub-scanning direction. The nozzles 20 belonging to the four nozzle rows 21 eject ink in such a way that ink of the same color is ejected from two nozzle rows which are adjacent to each other in the sub-scanning direction. The lower surface of the nozzle plate 13 having these nozzles 20 functions as an ink ejection surface 7.

The cavity plate 10 is provided with plural pressure chambers 14 corresponding to the plural nozzles 20. Each pressure chamber 14 has a substantially elliptical shape wide in the conveyance direction, and one end of the pressure chamber 14 is arranged to overlap the nozzle 20 in a plan view. The base plate 11 has through holes 15 and 16 which overlap, in a plan view, the respective longitudinal ends of the pressure chamber 14.

Figure 4:
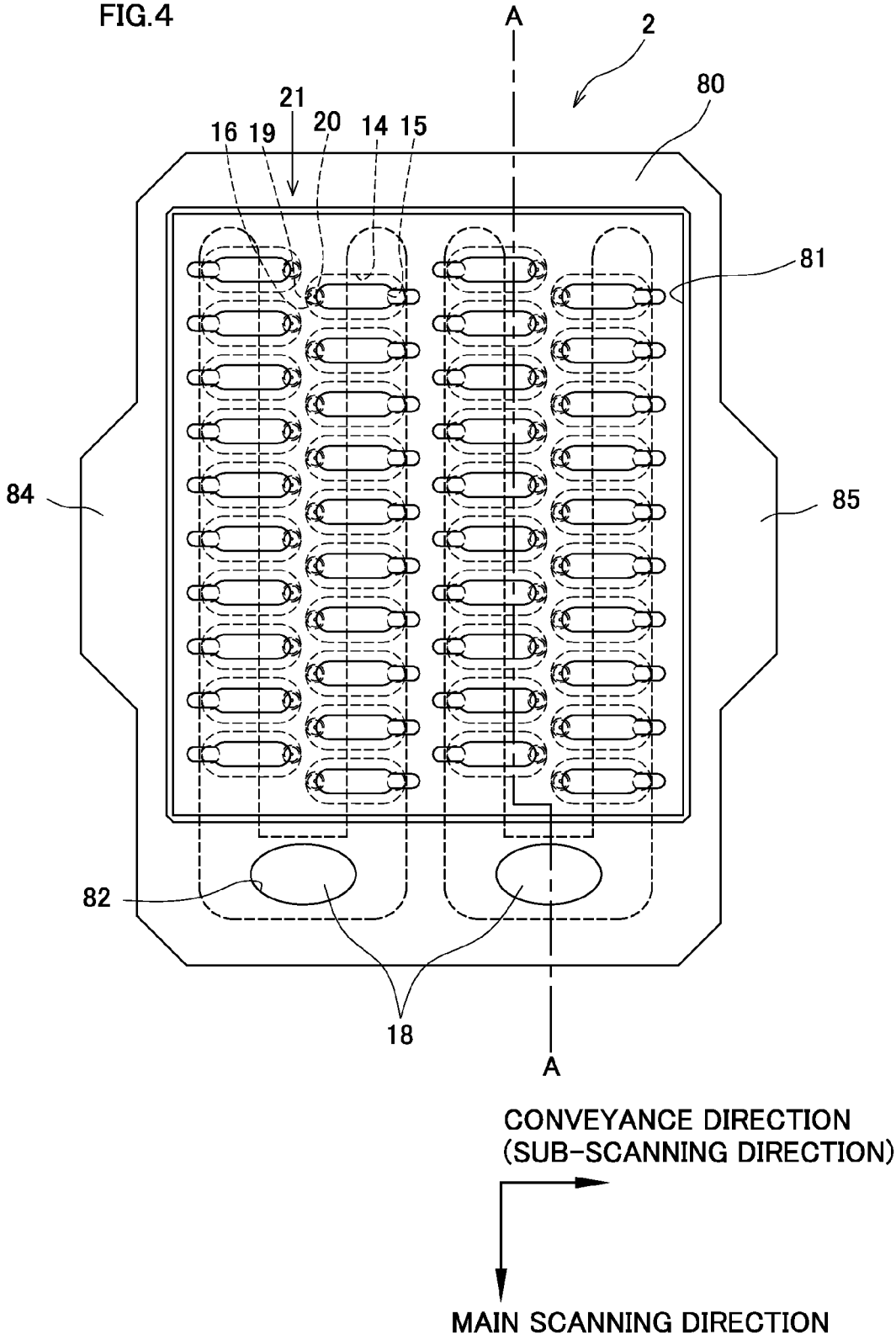
FIG. 4 is a plan view of a head unit.
Figure 5:
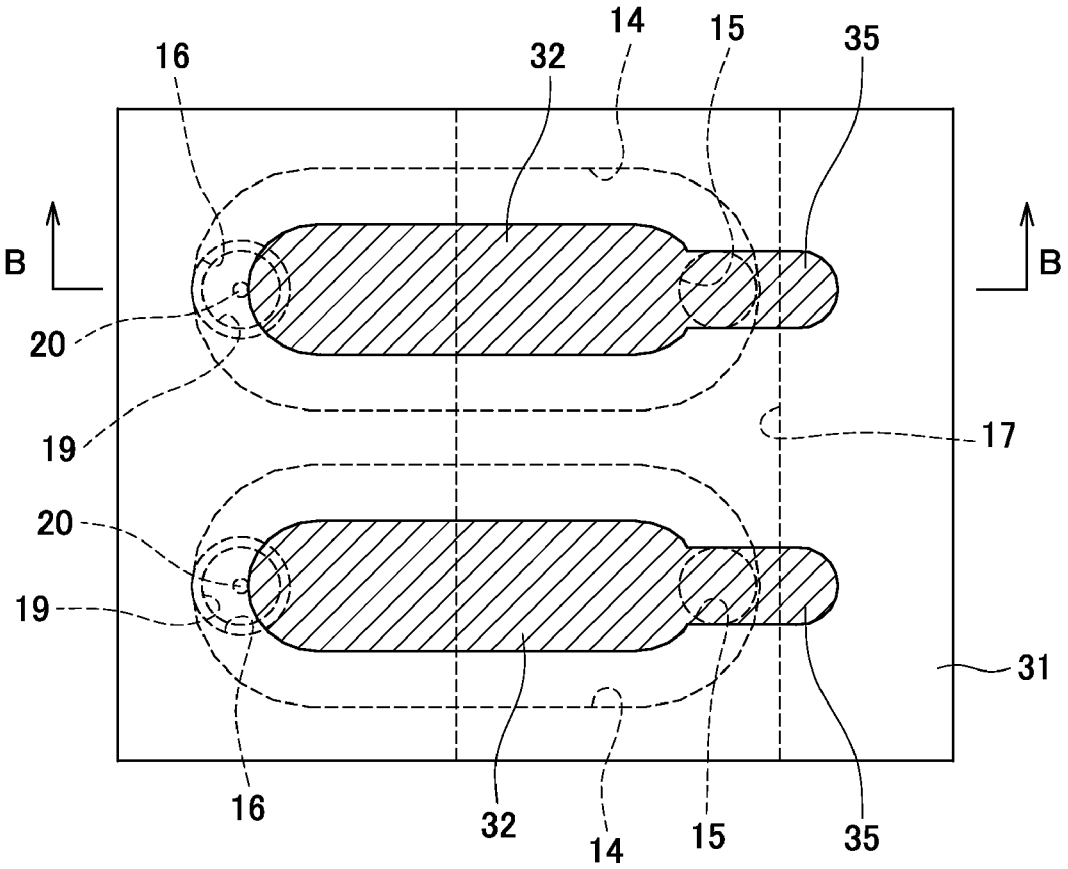
FIG. 5 is a partial enlarged view of FIG. 4.

The manifold plate 12 has four manifold passages 17 corresponding to the respective four nozzle rows 21. Each manifold passage 17 extends in the main scanning direction at the location where the passage 17 neighbors the corresponding nozzle row 21 in the conveyance direction, and overlaps a substantially half of the corresponding pressure chamber 14 in a plan view. Furthermore, as shown in FIG. 4, one end of each of the four manifold passages 17 (i.e. the lower end in FIG. 4) is connected to one of two ink supply openings 18 penetrating the cavity plate 10 which is the topmost layer, and two neighboring manifold passages 17 are connected to the same supply opening 18. The manifold plate 12 is provided with through holes 19 which overlap both the through holes 16 of the base plate 11 and the nozzles 20 of the nozzle plate 13 in plan view.

Figure 6:
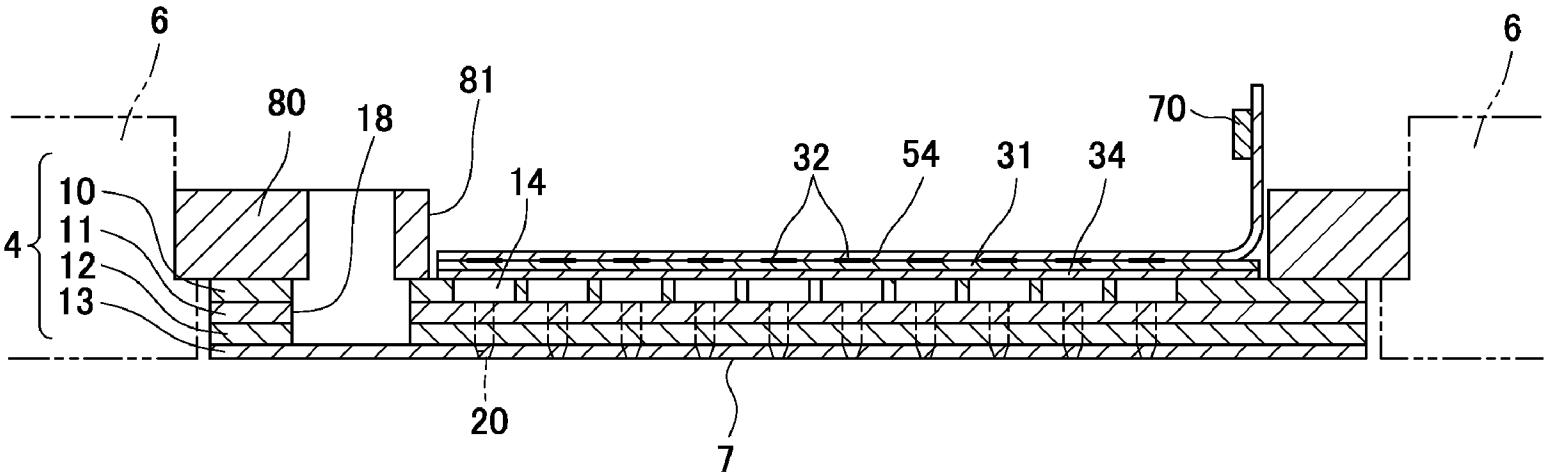
FIG. 6 is a cross section taken at A-A line in FIG. 4.
Figure 7:
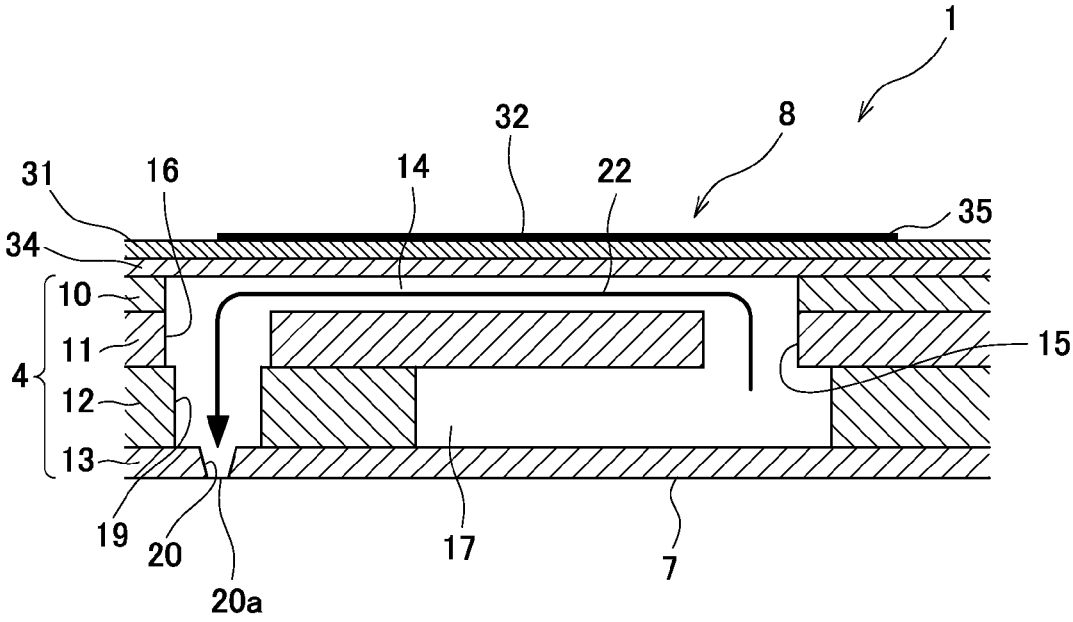
FIG. 7 is a cross section taken at B-B line in FIG. 5.

As shown in FIG. 6 and FIG. 7, the passage unit 4 is arranged so that the manifold passages 17 connected to the ink supply openings 18 are connected to the pressure chambers 14 via the through holes 15, and the pressure chambers 14 are further connected to the nozzles 20 via the through holes 16 and 19. In other words, the passage unit 4 has plural ink flow passages 22 stretching from the ink supply openings 18 to the nozzles 20 via the manifold passages 17 and the pressure chambers 14.

The piezoelectric actuator 8 has a diaphragm 34, a piezoelectric layer 31, and plural individual electrodes 32. The diaphragm 34 is made of a conductive material such as a metal material, and is connected to the upper surface of the cavity plate 10 so as to cover the plural pressure chambers 14. The conductive diaphragm 34 functions, as described later, as a common electrode which applies an electric field to a portion of the piezoelectric layer 31 which portion is sandwiched between the diaphragm 34 and the individual electrodes 32. The diaphragm 34 is connected to a ground wire at an unillustrated position, so that it is always kept at a ground potential.

The piezoelectric layer 31 is a mixed crystal of lead titanate and lead zirconate, and is made of a piezoelectric material mainly made of lead zirconate titanate (PZT) having ferroelectricity. This piezoelectric layer 31 is provided on the upper surface of the diaphragm 34 so as to stretch across the plural pressure chambers 14. The piezoelectric layer 31 is polarized in the thickness direction in advance.

The plural individual electrodes 32 are provided on the upper surface of the piezoelectric layer 31 so as to correspond to the respective pressure chambers 14. Each individual electrode 32 has a substantially elliptical shape in plan view and is smaller than the pressure chamber 14, and overlaps a substantially central portion of the pressure chamber 14 in plan view. One longitudinal end of the individual electrode 32 (i.e. the right end in FIG. 5) extends rightward but does not overlap the pressure chamber 14 in plan view, and the tip of this end functions as a contact 35. This contact 35 is connected to one terminal of the FPC 54 (see FIG. 6).

The FPC 54 is formed in such a way that wires made of a conductive material such as copper are printed on an insulator made of a resin material such as polyimide and a flexible base. This FPC 54 has a fixed part which is fixed to the upper surface of the piezoelectric actuator 8. The FPC 54 further has a non-fixed part which extends in the main scanning direction from the end of the passage unit 4 which end is opposite to the end where the ink supply opening 18 is formed, and is curved and extend upward along the inner wall surface of an opening 81 of a later-described reinforcing plate 80. In the space above the FPC 54 provided is a driver IC 70. This driver IC 70 selectively supplies either a predetermined drive potential or a ground potential to the individual electrode 32 via a wire formed on the FPC 54.

The function of the above-described piezoelectric actuator 8 will be discussed. When no pressure is applied to the ink (i.e. when the ink is not ejected from the nozzles 20), the electric potential of each individual electrode 32 is kept at the ground potential in advance. To one of the individual electrodes 32 in this state, a predetermined drive potential is supplied from the driver IC 70 via plural wires of the FPC 54. In response to this, a potential difference occurs between the individual electrode 32 to which the drive potential has been supplied and the diaphragm 34 which functions as a common electrode and is kept at the ground potential, with the result that an electric field in parallel to the thickness direction is generated at the piezoelectric layer 31 sandwiched between the aforesaid electrode 32 and the diaphragm 34. Since the direction of this electric field is identical with the polarization direction of the piezoelectric layer 31, the piezoelectric layer 31 polarized in the thickness direction contracts in the horizontal direction orthogonal to the direction of the electric field (transversal piezoelectric effect). Therefore a part of the piezoelectric layer 31, which part opposes the pressure chamber 14, deforms to bulge toward the pressure chamber 14 (unimorph deformation). Because this reduces the capacity of the pressure chamber 14, the pressure applied to the ink in the chamber increases and hence the ink is ejected from the nozzles 20 connected to the pressure chambers 14.

Now the reinforcing plate 80 will be discussed. As shown in FIG. 4 and FIG. 6, the reinforcing plate 80 is made of a metal material such as stainless steel, and is sufficiently thicker than the passage unit 4 and has high rigidity. Also, the reinforcing plate 80 has a substantially rectangular shape larger than the outer shape of the passage unit 4 in plan view, and has the rectangular opening 81 which is larger than the outer shape of the piezoelectric actuator 8 and accommodates the actuator 8 therein. Furthermore, at one end of the reinforcing plate 80 (lower end in FIG. 4), two openings 82 are formed to overlap the two ink supply openings 18 of the passage unit 4 in plan view.

The reinforcing plate 80 has two openings 82 corresponding to the two ink supply openings 18. For this reason the reinforcing plate 80 is arranged so that, in the main scanning direction, the area (lower area in FIG. 4) between an edge of the plate 80 and the space (ink ejection surface 7) where the piezoelectric actuator 8 is accommodated in the opening 81, in which area the ink supply openings 18 are formed, is much larger than the area (upper area in FIG. 4) between the other edge of the plate 80 and the aforesaid space. This reinforcing plate 80 is connected to the upper surface of the cavity plate 10 while being in parallel to the ink ejection surface 7 and while the piezoelectric actuator 8 is accommodated in the opening 81. This reinforcing plate 80 has a function to reinforce the passage unit 4 in order to prevent the direction of ink ejection from the nozzles 20 from being deviated due to the reasons such as the deformation of the passage unit 4.

The four corners of the reinforcing plate 80 are chamfered at a predetermined angle (45 degrees in the present embodiment) with respect to the main scanning direction. From the both edges of the reinforcing plate 80 in the width direction, which edges overlap the passage unit 4 in the sub-scanning direction of the reinforcing plate 80 (i.e. the horizontal direction in FIG. 4: sub-scanning direction), trapezoidal ear portions 84 and 85 protrude outwards, respectively. The angles of the slopes of the ear portions 84 and 85 with respect to the main scanning direction are identical with the angles of the champers of the four corners of the reinforcing plate 80. Thanks to these ear portions 84 and 85, the reinforcing plate 80 is easy to carry at the time of manufacture.

The passage unit 4 and the piezoelectric actuator 8 are attached to the above-described reinforcing plate 80, so that the head unit 2 is constructed.

Now the housing 6 will be described. As shown in FIG. 2 and FIG. 3, the housing 6 is rectangular in plan view and is supported by a chassis 25 of the printer (see FIG. 1). This housing 6 is provided with plural openings 6*a* which forms four rows in a staggered manner in the main scanning direction so as to correspond to the positions of the plural ink ejection surfaces 7. The number of the openings 6*a* is an integral multiple of 4.

Each opening 6*a* accommodates the passage unit 4 of the head unit 2 in such a way that the direction of the nozzle rows is in parallel to the main scanning direction. This passage unit 4 is accommodated so that the ink ejection surface 7 opposes in a parallel manner a record sheet P which is conveyed by the conveyor rollers 5. The lower surface of the housing 6 and the ink ejection surface 7 are on the same plane. The plural openings 6*a* are formed in such a way that, when the plural passage units 4 are respectively accommodated, the distance between two nozzles 20 neighboring in the main scanning direction in a single head unit 2 is identical with the distance between two nozzles 20 which are the closest to each other in the main scanning direction and belong to neighboring two head units 2, respectively. In other words, provided that a group of the head units 2 forming two rows in a staggered manner in the main scanning direction constitute a single line-type inkjet head 3, the nozzles 20 neighboring one another in the main scanning direction are equally distanced with one another, and hence the inkjet head 3 constitutes a virtual single nozzle row which is longer than the nozzle row of each head unit 2.

As the lower surfaces of the reinforcing plates 80 of the plural head units 2 are joined with the upper surface of the housing 6, the plural head units 2 are fixed to the housing 6. As such, in the housing 6, two head units 2 neighboring each other in the conveyance direction are provided to deviate from each other in the main scanning direction.

The plural passage units 4 in the housing 6 are grouped into four rows of passage units as shown in FIG. 2, namely the leftmost row of passage units, the second leftmost row of passage units, the second rightmost row of passage units, and the rightmost row of passage units. Each row of passage units extends in the main scanning direction and includes four passage units each having four rows of nozzles. In the leftmost row of passage units, the left two rows of nozzles eject black ink and the right two rows of nozzles eject yellow ink. In the second leftmost row of passage units which forms a staggered arrangement with the leftmost rows of passage units, the left two rows of nozzles eject black ink and the right two rows of nozzles eject yellow ink. In the rightmost row of passage units, the left two rows of nozzles eject cyan ink and the right two rows of nozzles eject magenta ink. In the second rightmost row of passage units which forms a staggered arrangement with the rightmost rows of passage units, the left two rows of nozzles eject cyan ink and the two right rows of nozzles eject magenta ink. In this manner, the inkjet head 3 ejects four colors of ink in such a way that two rows of passage units neighboring each other in the sub-scanning direction eject ink with the same colors.

The head units 2, the number thereof is an integral multiple of 4, are arranged so that two head units 2*a* and 2*b* neighboring each other in the main scanning direction and two head units 2*c* and 2*d* forming a staggered arrangement with the two head units 2*a* and 2*b* constitute a single head unit set 40. In the present embodiment, there are four head unit sets 40 which form two rows in the main scanning direction.

In each head unit 2, the nozzle arrangement area and the ink supply openings 18 are disposed in the main scanning direction. Two head units 2*a* and 2*c* belong to one head unit set 40 and neighbor each other in the main scanning direction. Between these head units 2*a* and 2*c*, the nozzle arrangement area and the ink supply openings 18 are arranged in an opposite manner in the main scanning direction, and hence the edges of the respective head units, where the ink supply openings 18 of the passage unit 4 are provided, oppose each other in the main scanning direction. Similarly, two head units 2*b* and 2*d* belong to one head unit set 40 and neighbor each other in the main scanning direction. Between these head units 2*b* and 2*d*, the nozzle arrangement area and the ink supply openings 18 are arranged in an opposite manner in the main scanning direction, and hence the edges of the respective head units, where the ink supply openings 18 of the passage unit 4 are provided, oppose each other in the main scanning direction.

The reinforcing plates 80 of the two head units 2*a* and 2*b* are in contact with each other at the end faces of the edges in the sub-scanning direction where the ear portions 84 and 85 are not formed. Also, the reinforcing plates 80 of the two head units 2*c* and 2*d* are in contact with each other at the end faces of the edges in the sub-scanning direction where the ear portions 84 and 85 are not formed. The slopes of the ear portion 84 of the head unit 2*c* sandwiched between the head units 2*a* and 2*b* in the main scanning direction are in contact with the chamfered edges of the reinforcing plates 80 of the head units 2*a* and 2*b*. Furthermore, the slopes of the ear portion 85 of the reinforcing plate 80 sandwiched between the head units 2*c* and 2*d* in the main scanning direction are in contact with the chamfered edges of the reinforcing plates 80 of the head units 2*c* and 2*d*.

After the reinforcing plates 80 are positionally adjusted in the main scanning direction, an adhesive made of photocurable (ultraviolet curable) resin is injected into the gap between the neighboring two reinforcing plates 80, so that these neighboring reinforcing plates 80 are fixed to each other. In this regard, the reinforcing plates 80 of the two head units 2*a* and 2*b* which belong to one head unit set 40 and provided along the main scanning direction are joined, by the adhesive, with the reinforcing plates 80 of the two head units 2*c* and 2*d* of the other row, at the bended edges formed by the existence of the ear portions 84 and 85. The joining force in this case is strong as compared to a case where the plates not having ear portions are joined at straight edges.

In this way, the ear portions 84 and 85 are formed to overlap each other in the main scanning direction, only at the portion where the ink ejection surface 7 of the passage unit 4 is provided and high rigidity is required. This makes it possible to certainly reinforce the passage unit 4, while the head units 2 are densely disposed in the sub-scanning direction. Furthermore, since these ear portions 84 and 85 bulge toward the dead spaces formed by the staggered head units 2, they do not obstruct the downsizing of the printer.

In addition to the above, the plural ink supply openings 18 are provided in the main scanning direction of the ink ejection surface 7. As compared to a case where the openings 18 are provided in the sub-scanning direction of the ink ejection surface 7, the distance between the head units 2 in the sub-scanning direction (nozzle row distance) is small and hence the entire apparatus is downsized. Furthermore, the impact accuracy of ink onto a record sheet P from the nozzles 20 when the head units 2 are inclined is improved. In the meanwhile, the ink supply openings 18 are provided in the dead spaces formed by the staggered head units 2, thereby allowing the printer to be downsized.

The two head units 2 of one head unit set 40, which are disposed in the main scanning direction, are arranged so that their respective edges where the ink supply openings 18 of the passage unit 4 are provided oppose each other. Because of this arrangement, when the housing 6 is provided with plural head unit sets 40 in the main scanning direction, two head units 2 which belong to different head unit sets 40 but neighbor each other in the main scanning direction are arranged so that their edges opposite to the ink supply openings 18 of the passage unit 4 oppose each other in the main scanning direction. Since these edges opposite to the ink supply openings 18 of the head unit 2 do not greatly protrude in the main scanning direction as compared to the edges where the ink supply openings 18 are formed, a large space is secured between the head units 2.

The housing 6 has plural openings 6*b* in the aforesaid spaces and each opening 6*b* is provided with a spur 90. In other words, an opening 6*b* is formed between two head units 2 which belong to different head unit sets 40 of the housing 6, respectively, and which neighbor each other in the main scanning direction. Each opening 6*b* is provided with a rotation shaft 91 in addition to the spur 90. As shown in FIG. 2, the both ends of the rotation shaft 91 are supported by the edges forming the opening 6*b* in such a way that the shaft direction is in parallel to the main scanning direction. The height position of the spur 90 is determined so that the spur 90 can rotate while being in contact with a record sheet P conveyed by the conveyor mechanism 9 (see FIG. 8).

Figure 8:
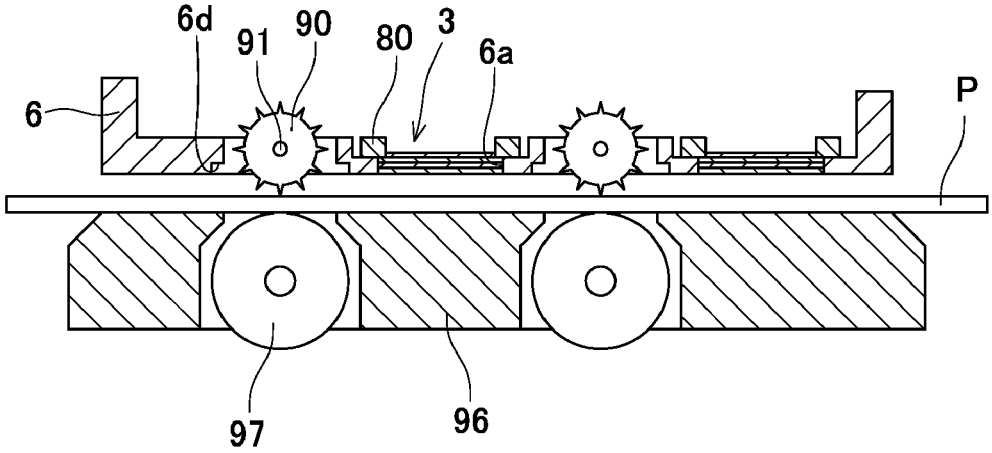
FIG. 8 is a cross section taken at C-C line in FIG. 2.

In addition to the above, as shown in FIG. 8, between two conveyor rollers 5 in the conveyance direction, a drive roller 97 is provided to oppose the spur 90. This driver roller 97 is supported by the supporting member 96 and driven by an unillustrated drive motor. To put it differently, the spur 90 and the drive roller 97 form a roller pair, and a record sheet P conveyed by the conveyor mechanism 9 is sandwiched between the spur 90 and the drive roller 97.

The spur 90 rotates while being in contact with a record sheet P conveyed by the conveyor mechanism 9, so as to push the record sheet P away from the ink ejection surface 7. This prevents a record sheet P conveyed by the conveyor mechanism 9 from being warped. It is noted that the spurs 90 are provided in the aforesaid large spaces where no head units 2 are disposed in the housing 6. Therefore the downsizing of the inkjet head 3 is possible even if the spurs 90 are provided.

In addition to the above, as shown in FIG. 8, the housing 6 has a concave portion 6*d* at the lower surface. This concave portion 6*d* surrounds the spur 90 and is larger than the opening 6*b*. The concave portion 6*d* functions in such a way that, when ink droplets are ejected from the nozzles 20, the ink which does not impact on the record sheet P and remains on the ink ejection surface 7 is accumulated in the concave portion 6*d* before reaching the spur 90, with the result that the intrusion of the ink to the spur 90 is prevented.

Now, an ink supply passage from an unillustrated ink tank to the ink supply openings 18 of the passage unit 4 will be described.

Figure 9:
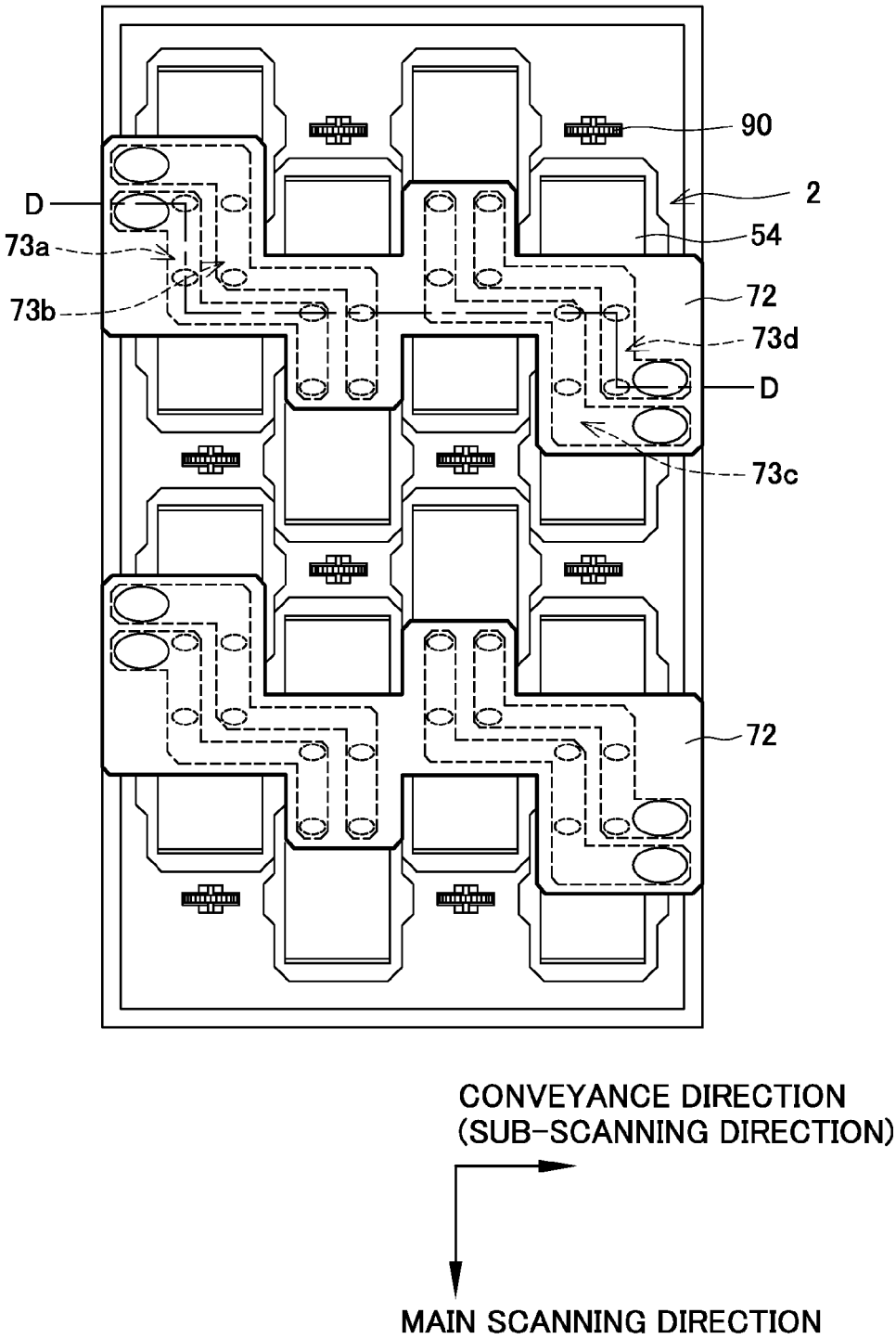
FIG. 9 is a plan view from above looking down the inkjet head provided with an ink supplier.
Figure 10:
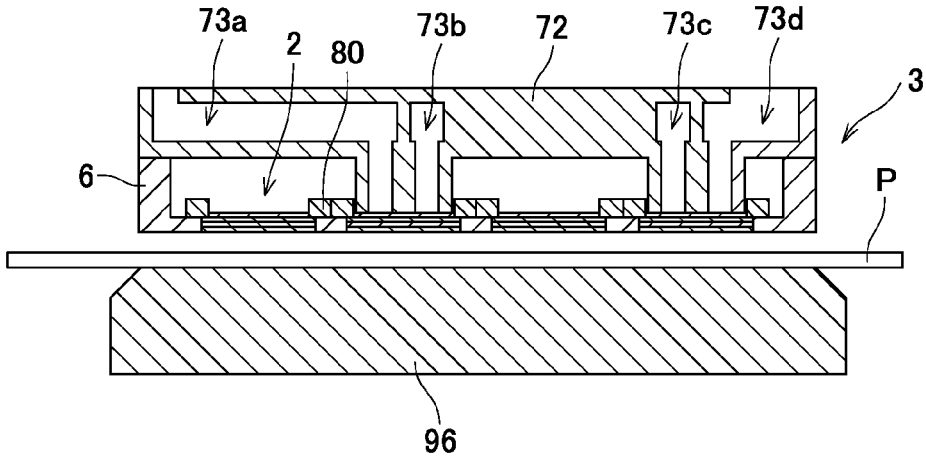
FIG. 10 is a cross section taken at D-D line in FIG. 9.

As shown in FIG. 9 and FIG. 10, the upper surface of the housing 6 is provided with ink suppliers 72 for the respective two groups of head unit sets 40 which neighbor each other in the sub-scanning direction. In the main scanning direction, substantially half of each head unit 2 is covered with the ink supplier 72, and the ink supply openings 18 are formed in the covered portions. In the ink supplier 72 formed are four ink flow passages 73*a*-73*d*.

One opening of the ink flow passage 73*a* is made on the upper surface of the ink supplier 72 and is at the edge in the sub-scanning direction, whereas the other openings are branched and connected to four respective ink supply openings 18 through which black ink is supplied. One opening of the ink flow passage 73*b* is made on the upper surface of the ink supplier 72 and is at the edge in the sub-scanning direction, whereas the other openings are branched and connected to four respective ink supply openings 18 through which yellow ink is supplied. The ink flow passages 73*c* and 73*d* and the ink flow passages 73*a* and 73*b* are point symmetric with respect to the center of the ink supplier 72. Each of the ink flow passages 73*c* and 73*d* is branched and connected to four ink supply openings 18 through which cyan or magenta ink is supplied. Said one opening of each of the four ink flow passages 73*a*-73*d* is connected to the unillustrated ink tank via a tube or the like. The ink in the ink tank is supplied to an ink supply opening 18 via one of the four ink flow passages 73*a*-73*d*, and reaches the nozzles 20 via the ink flow passage 22.

The ink supply openings 18 of the staggered four head units 2 belonging to one head unit set 40 are arranged so that the edges of two head units 2 neighboring each other in the main scanning direction, which edges are close to the ink supply openings 18 of the passage unit 4, oppose each other in the main scanning direction. With this, the ink supply openings 18 of the four head units 2 belonging to one head unit set 40 are close to one another both in the main scanning direction and in the sub-scanning direction, i.e. these ink supply openings 18 are densely provided in a small area. Therefore only one ink supplier 72 is required for the connection to these ink supply opening 18, and hence the downsizing and simple structure are realized. Furthermore, since all head units 2 are grouped into head unit sets 40, the structure of the ink suppliers 72 is simplified throughout the inkjet printer 1.

In addition to the above, the FPC 54 has a non-fixed part extending from the edge opposite to the ink supply opening 18 connected to the ink supplier 72 of the passage unit 4. Since the non-fixed part of the FPC 54 extends in the direction away from the ink supply opening 18, the interference between the ink supplier 72 and the FPC 54 is restrained, thereby allowing compact disposition of the FPC 54 and the ink supplier 72.

<Second Embodiment>

The following will now describe preferred Second Embodiment of the present invention. Second Embodiment is identical with First Embodiment except that the spur 90 between two head unit sets 40 neighboring each other in the main scanning direction is replaced with a heat sink. It is noted that the components identical with those in First Embodiment are denoted by the same reference numerals and not described again.

Figure 11:
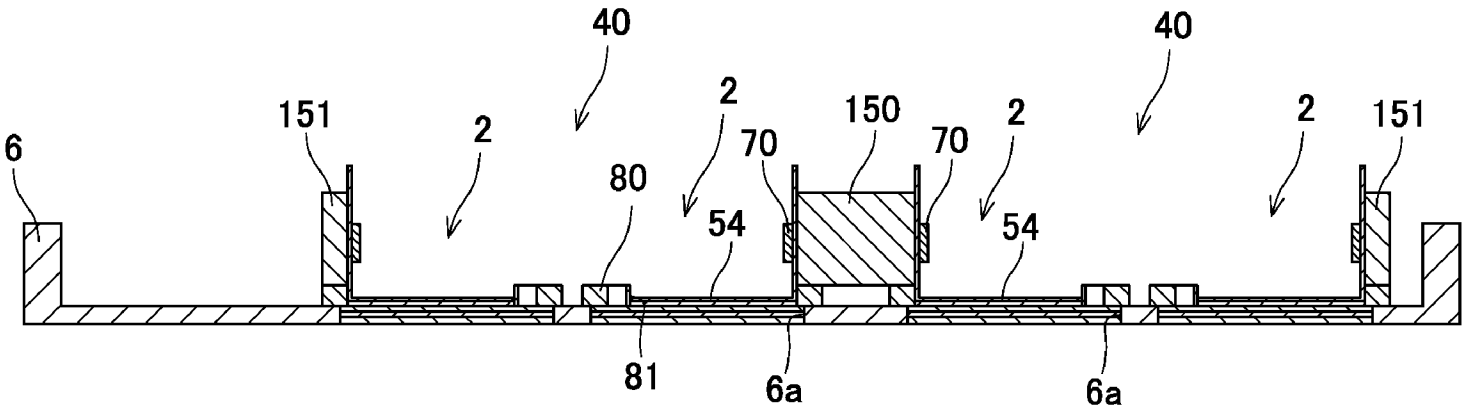
FIG. 11 is a longitudinal section of the inkjet head along the main scanning direction.

As shown in FIG. 11, above the space between the reinforcing plates 80 of two head units 2 which belong to different head unit sets 40, respectively, and which neighbor each other in the main scanning direction, a rectangular heat sink 150 is provided. On the other hand, other heat sinks 151 which are shorter in the main scanning direction than the heat sink 150 are provided above the reinforcing plates 80 of the respective edges of other two head units 2 which belong to different head unit sets 40, respectively, and which do not neighbor each other in the main scanning direction, each edge where the heat sink 151 is provided being far from the ink supply openings 18 in the head unit 2.

The heat sink 150 is in contact with portions of the respective two head units 2 which belong to different head unit sets 40, respectively, and which neighbor each other in the main scanning direction. These portions extend upward along the inner walls of the openings 81 of the reinforcing plates 80 of the FPCs 54 of the respective two head units 2. Each driver IC 70 connected to the FPC 54 opposes the heat sink 150 with the FPC 54 being interposed therebetween.

The heat sinks 151 are in contact with portions of two head units 2 which belong to different head unit sets 40, respectively, and which do not neighbor each other in the main scanning direction. These portions extend upward along the inner walls of the openings 81 of the reinforcing plates 80 of the FPCs 54 of the respective two head units 2. Each driver IC 70 connected to the FPC 54 opposes the heat sink 151 with the FPC 54 being interposed therebetween.

Since the heat sinks 150 and 151 in contact with the FPCs 54 are provided in this manner, the driver ICs 70 are effectively cooled. In addition to this, the heat sink 150 is provided above the aforesaid dead space between two head units 2 and is in contact with the non-fixed parts of two FPCs 54 which parts extend from these head unit 2. It is therefore possible to realize the downsizing of the printer even if the heat sink 150 is provided.

Now, various variations of the aforesaid embodiment will be described. In the present embodiment, a first row of head units 2 along the main scanning direction is adjacent in the sub-scanning direction to a second row of head units 2 along the main scanning direction, which form a staggered arrangement with the aforesaid first row of head units 2, and these first and second rows of head units eject ink of the same colors. Alternatively, these first and second rows of head units 2 are not adjacent to each other and a third row of head units 2 extending in the main scanning direction and ejecting different colors of ink is sandwiched between the first and second rows of head units 2. Furthermore, this third row of head units 2 may not be adjacent in the sub-scanning direction to a fourth row of head units 2 extending in the main scanning direction, with which the third row of head units 2 forms a staggered arrangement. In other words, any kinds of arrangements may be employed as long as two head units 2 disposed along the main scanning direction are arranged to oppose each other on the sides where the supply openings 18 of the passage units 4 are provided, among four head units 2 belonging to a single head unit set 40, and the ink supplier 72 can supply ink to at least two opposing ink supply openings 18. Plural ink suppliers 72 for supplying ink to the two opposing ink supply openings 18 may be formed.

In the present embodiment, the reinforcing plate 80 is chamfered so that the ear portions 84 and 85 are formed. Alternatively, the reinforcing plate 80 may have a rectangular shape.

In addition to the above, the mechanism for pushing a record sheet P from the ink ejection surface 7 toward the conveyor mechanism 9 is not limited to the spurs. It is possible to adopt such an arrangement that openings are formed to penetrate in the thickness direction the areas of the housing 6 where the spurs are to be formed, and a record sheet P conveyed by the conveyor mechanism 9 is pushed by air ejected through these openings.

In addition to the above, in the present embodiment there are four nozzle rows in the main scanning direction. The number of nozzle rows, however, may be different from four.

In the Second Embodiment, the driver ICs 70 are cooled by the heat sinks 150 and 151 via the FPCs 54. Alternatively, the driver ICs 70 are connected to the surfaces of the FPCs 54 which surfaces are in contact with the heat sinks 150 and 151, so that the driver ICs 70 are directly in contact with the heat sinks 150 and 151 and directly cooled by the heat sinks 150 and 151.

In the present embodiment, ink is supplied from the unillustrated ink tank to the ink supply opening 18 via the ink supplier 72. Alternatively, the ink tank is connected to the ink supply opening 18 by a flexible tube or the like. In this case, the structure of the ink supplier supplying ink to the ink supply openings 18 can be simplified because, for example, it is possible to tie up the tubes connected to four ink supply openings 18 thanks to the concentration of the ink supply openings 18 of the four head units 2 belonging to a single head unit set 40.

In addition to the above, in the present embodiment a line-type inkjet head 3 which is long in one direction is formed by arranging plural head units 2 in a staggered manner. Alternatively, it is possible to adopt a serial-type inkjet head constituting a virtual nozzle row which is long in one direction (conveyance direction) in such a way that plural head units 2 are staggered.

The present embodiment is an example in which the present invention is used for an inkjet printer which forms an image or the like by ejecting ink onto a record sheet. The application of the present invention, however, is not limited to this. The present invention is applicable for various droplet ejectors which suitably eject various kinds of liquid other than ink onto an object.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A droplet ejector comprising:

at least one head unit set each composed of four head units which are disposed in a staggered manner in an arrangement direction on a plane;

a head supporting member which supports said at least one head unit set;

a liquid supplier which supplies liquid to said at least one head unit set; and a conveyor mechanism which conveys, in an area opposing said at least one head unit set, an ejection target in a direction in parallel to the plane;

each of the head units including:

a passage structure having plural nozzles disposed in the arrangement direction and a liquid passage connected to the nozzles; and a liquid supply opening which is provided at an edge of passage structure in the arrangement direction and which is connected to the liquid passage and the liquid supplier, the passage structures of two of the head units neighboring each other in the arrangement direction being arranged so that the respective edges where the liquid supply openings are provided oppose each other in the arrangement direction.

2. The droplet ejector according to claim 1, wherein, each of the head units includes:

an actuator unit which is provided in the passage structure and provides ejection energy to liquid in the liquid passage; and a wiring component which has a fixed part connected to the actuator unit, and the wiring component further has a non-fixed part whose boundary with the fixed part is at an edge opposite to the liquid supply opening of the passage structure.

3. The droplet ejector according to claim 1, wherein, the head supporting member has the head units, the number of these head units being an integral multiple of four, and all of the head units are arranged in a staggered manner four by four so as to constitute said at least one head unit set.

4. The droplet ejector according to claim 1, wherein, two head unit sets are disposed in the arrangement direction, and the passage structures of two head units which belong to different ones of said at least one head unit set, respectively, and which neighbor each other in the arrangement direction are arranged so that respective edges of the two head units which edges are opposite to the edges at which the liquid supply openings are formed oppose each other in the arrangement direction.

5. The droplet ejector according to claim 4, further comprising:

a pushing mechanism which pushes, in a direction of droplet ejection from the nozzles, the ejection target conveyed by the conveyor mechanism, wherein, the pushing mechanism is disposed between the two head units which belong to the two different head unit sets, respectively, and which neighbor each other in the arrangement direction.

6. The droplet ejector according to claim 4, wherein, each of the head units includes:

an actuator unit which is provided in the passage structure and provides ejection energy to liquid in the liquid passage; and a wiring component which has a fixed part connected to the actuator unit and on which a driver IC is mounted, the wiring component further has a non-fixed part whose boundary with the fixed part is at an edge opposite to the liquid supply opening of the passage structure, and a heat sink is provided between the two head units which belong to the two head unit sets, respectively, and which neighbor each other in the arrangement direction, the heat sink being in contact with the two wiring components fixed to the two head units.

* * * * *